US005607320A

United States Patent [19]

Wright

[11] Patent Number: 5,607,320

[45] Date of Patent: Mar. 4, 1997

[54] CABLE CLAMP APPARATUS

[75] Inventor: John O. Wright, York, Pa.

[73] Assignee: Osram Sylvania Inc., Danvers, Mass.

[21] Appl. No.: 535,421

[22] Filed: Sep. 28, 1995

[51] Int. Cl.[6] ..... H01R 4/24

[52] U.S. Cl. ..... 439/394; 439/98

[58] Field of Search ..... 439/98, 394, 434, 439/584

[56] References Cited

U.S. PATENT DOCUMENTS

| | | | |
|---|---|---|---|
| 4,178,054 | 12/1979 | Laudig | 439/394 |
| 4,261,632 | 4/1981 | Narozny | 439/394 |
| 4,696,908 | 9/1987 | Gutter et al. | 439/394 |
| 4,708,414 | 11/1987 | Lam | 439/394 |
| 5,362,251 | 11/1994 | Bielak | 439/394 |

FOREIGN PATENT DOCUMENTS

| | | | |
|---|---|---|---|
| 1109914 | 4/1968 | United Kingdom | 439/394 |

*Primary Examiner*—Neil Abrams
*Assistant Examiner*—Brian J. Biggi
*Attorney, Agent, or Firm*—William H. McNeill

[57] ABSTRACT

A conductive cable clamp is provided which may be attached to an end region of a coaxial cable in such a manner that a portion of the cable clamp penetrates the outer insulative jacket of the coaxial cable and contacts the ground wire braid of the coaxial cable. Such ground wire braid is severed at the end of the coaxial cable rather than being folded back towards the outer surface of the outer insulative jacket in the usual manner.

15 Claims, 4 Drawing Sheets

CABLE CLAMP APPARATUS

TECHNICAL FIELD

The present invention relates to a conductive cable clamp for use with a coaxial cable and to a coaxial cable assembly which includes such a clamp. More particularly, the present invention relates to such a cable clamp and coaxial cable assembly which is useful, without limitation, with conventional antenna connectors such as those used in the automobile industry for radios.

BACKGROUND ART

In many applications involving the use of a coaxial cable, it is known to strip one or both ends of the cable to expose a length of the center conductor. Typically, a length of ground wire braid is then folded back upon the cable. In some instances, a metal sleeve is crimped to the outer peripheral PVC surface of the coaxial cable adjacent the stripped end and the ground wire braid is folded back upon such metal sleeve. A metal shell may also be provided adjacent the stripped end, the ground wire braid being sandwiched between the metal sleeve and the metal shell. Processing a coaxial cable in this manner is time consuming and adds to the cost of preparing a coaxial cable for its intended use. Cables dressed in this manner are used, for example, with conventional antenna connectors such as those used in the automobile industry for radios. In such uses, each end of a coaxial cable prepared in this manner may have a respective connector such as a male or female connector mechanically and electrically attached thereto. It is known that if the ground wire braid is not dressed properly them may be a tendency for shorting between the ground wire braid and the center conductor if any portion of the ground wire braid is too close to the center conductor even though not in contact with the center conductor. Such shorting may occur immediately during use of the antenna cable or be intermittent in nature and occur sometime in the future.

It is known to test a coaxial cable for shorts by subjecting the cable to a low voltage. In such test, if the ground wire braid is actually in contact with the center conductor to thereby cause a short, an audible and/or visual indicator will be actuated in response thereto and the faulty coaxial cable may be discarded. In order to test for any shorts which may occur due to the fact that the ground wire braid is too close to, but not in contact with, the center conductor, the cable is mechanically manipulated. In particular, the cable is actually wiggled in an attempt to induce a short by bringing the ground wire braid into contact with the center conductor. This is a time consuming process and in fact, may not be successful in identifying a short-prone cable.

DISCLOSURE OF INVENTION

It is an object of the present invention to provide an improved conductive cable clamp for use with a coaxial cable.

It is yet another object of the present invention to provide a conductive cable clamp which can be attached to the end of a coaxial cable to conductively engage the cable ground wire braid without dressing the end of the cable to expose a length of ground wire braid.

Another object of the present invention is to provide a method of fabricating an improved coaxial cable assembly.

It is a further object of the present invention to provide an improved coaxial cable assembly which does not require testing for shorts caused by the ground wire braid.

It is another object of the present invention to provide an improved coaxial cable clamp for use with an antenna cable.

Yet another object of the present invention is to provide an improved coaxial cable assembly which is less costly than those fabricated heretofore.

This invention achieves these and other objects, in one aspect of the invention, by providing a conductive cable clamp for use with a coaxial cable, comprising a first component extending in the direction of a longitudinal axis from a first end to an opposite second end and a second component extending from such first end in the direction of such longitudinal axis. The second component is bendable relative to the first component and comprises a portion adapted for penetration of an outer insulative jacket of a coaxial cable. A coaxial cable assembly which includes such a cable clamp, and a method of fabricating such a coaxial cable assembly, is also disclosed.

BRIEF DESCRIPTION OF THE DRAWINGS

The invention may be clearly understood by reference to the attached drawings wherein like parts are designated by like reference numerals and in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
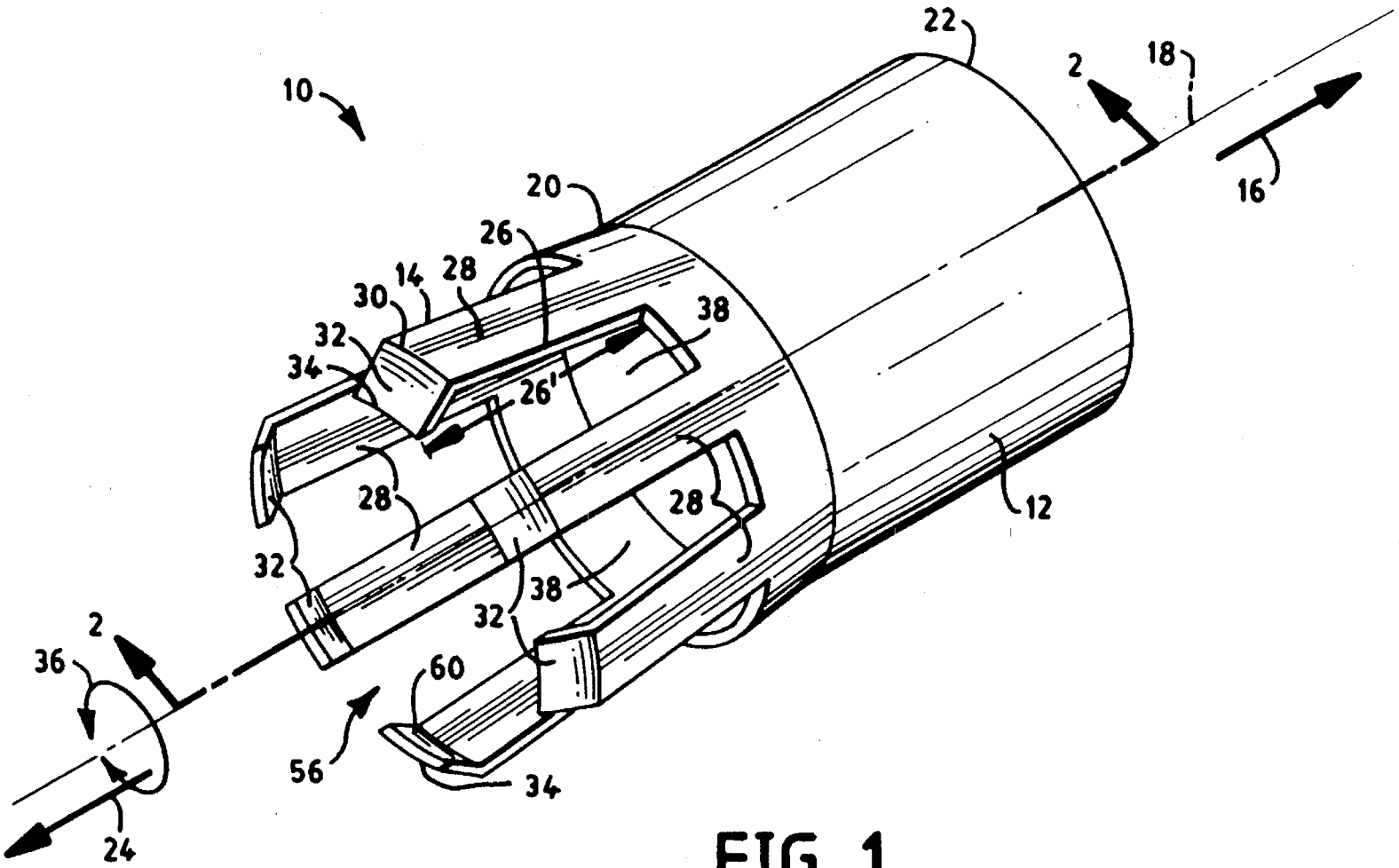
FIG. 1 is a perspective view of a conductive cable clamp embodying the present invention.

The embodiment which is illustrated in the drawings is one which is particularly suited for achieving the objects of this invention. FIG. 1 depicts a conductive cable clamp 10 for use with a coaxial cable as described herein. Without limitation, cable clamp 10 may be fabricated from a soft brass or copper alloy although other conductive materials may be used depending upon the particular end use of the coaxial cable to which the cable clamp is to be attached. Cable clamp 10 comprises a first component 12 and a second component 14. Component 12 extends in the direction 16 relative to longitudinal axis 18 from a first end 20 to an opposite second end 22. The second component 14 extends in the direction 24 relative to longitudinal axis 18 from the first end 20 of the component 12. Component 14 is bendable relative to component 12 and comprises a portion adapted for penetration of an outer insulative jacket of a coaxial cable as described herein.

In the embodiment depicted in FIG. 1, the second component 14 comprises a segment 26, the general length of which is designated by arrow 26', comprising a first length 28 which extends away from longitudinal axis 18 to a juncture 30 and a second length 32 which extends towards longitudinal axis 18 from juncture 30 to a distal end 34. In the embodiment depicted in FIG. 1 the second component 14 comprises a plurality of segments 26 each of which includes a first length 28 and a second length 32. Each segment 26 is spaced from an adjacent segment 26 in a circumferential direction 36 relative to longitudinal axis 18 such that adjacent segments 26 are separated by respective openings 38. In the preferred embodiment the segments 26 are equally spaced in circumferential direction 36. The embodiment depicted in FIG. 1 depicts six segments 26 although more or less than this number may be provided.

Figure 2:
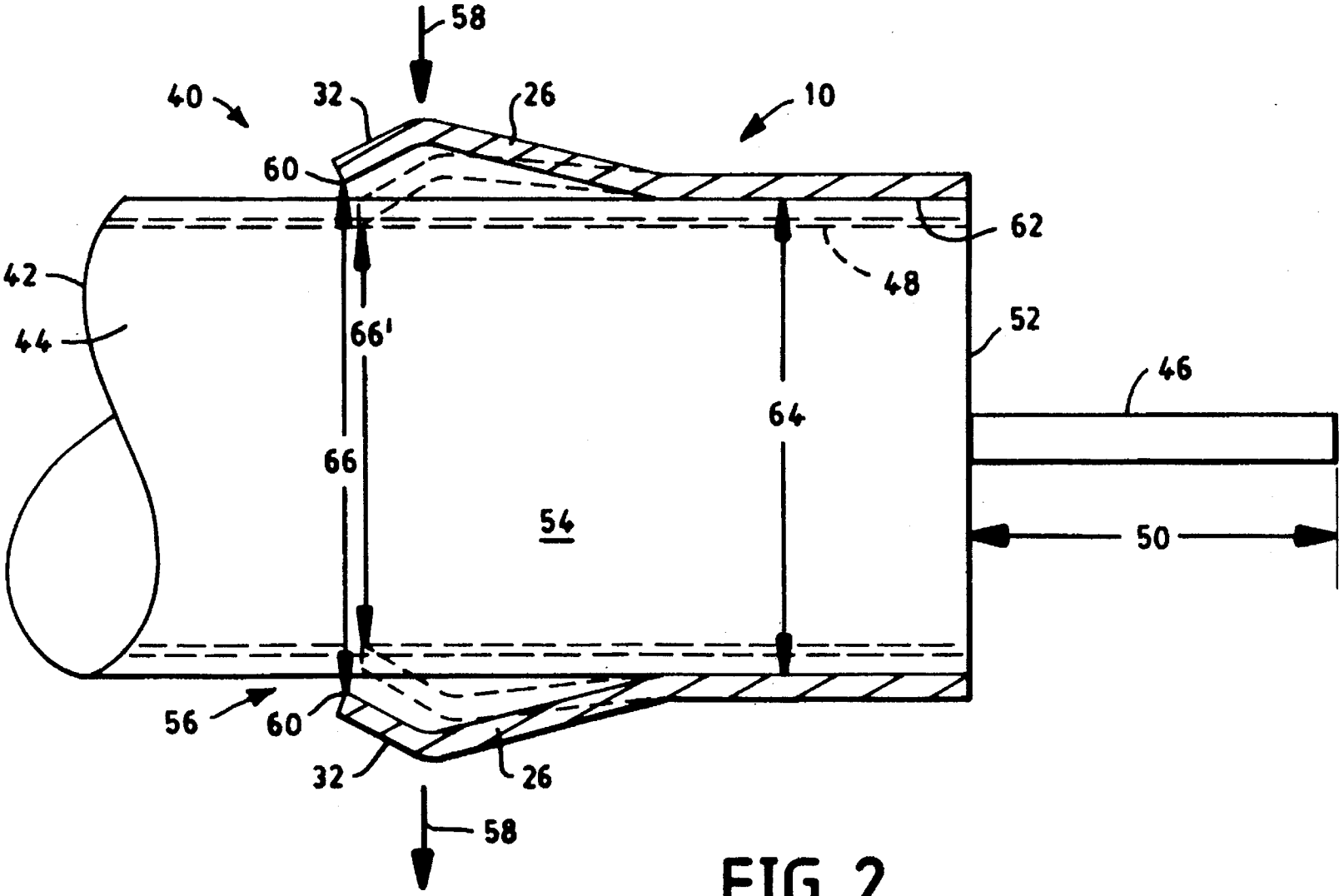
FIG. 2 is a partial view of the conductive cable clamp of FIG. 1 taken along the lines 2—2 depicting such conductive cable clamp in an inoperative (solid lines) and an operative (phantom lines) mode in combination with a coaxial cable.

The cable clamp 10 is useful in providing an improved coaxial cable assembly of the present invention. FIG. 2 depicts a coaxial cable assembly 40 comprising a coaxial cable 42 and the cable clamp 10 described herein. Coaxial cable 42 is a conventional coaxial cable diagrammatically depicted as having an outer insulative jacket 44 typically fabricated from PVC material, a center conductor 46 and a ground wire braid 48 positioned between the outer insulative jacket and the center conductor. Coaxial cable 42 has been dressed in the conventional manner to the extent that the center conductor 46 includes a length 50 which extends beyond an end 52 of the coaxial cable, and the outer insulative jacket 44 has been cut such that it terminates at end 52. The dressing of coaxial cable 42 is different from a conventional dressing in that the ground wire braid 48 has also been cut such that it terminates at end 52. In other words, rather than trimming the coaxial cable in the conventional manner to provide a length of ground wire cable which extends from end 52 and is then folded back towards the outer surface of the outer insulative jacket, any ground wire braid which would ordinarily extend beyond end 52 is cut such that the ground wire braid terminates at end 52.

In fabricating the coaxial cable assembly 40, an end region 54 of coaxial cable 42, dressed as described herein and depicted in FIG. 2, is inserted into a bore 56 which extends through cable clamp 10. Segments 26 are depicted in FIG. 2 in solid lines which designate the configuration of each respective segment 26 when the end region 54 of coaxial cable 42 has been inserted into bore 56. After end region 54 has been inserted into bore 56 as depicted in FIG. 2, segments 26 are bent in a direction 58 which is substantially normal to longitudinal axis 18 of cable clamp 10, the longitudinal axis of the coaxial cable 42 at end region 54 being coextensive with axis 18. Such bending of segments 26 causes a portion of the length 32 to penetrate the outer insulative jacket 44 and to engage the ground wire braid 48 as depicted in phantom lines in FIG. 2. Such penetration may be facilitated by providing each distal end 34 with a sharp edge 60 which will cut through the outer insulative jacket 44 when the segments 26 are bent in the direction 58 towards axis 18. In this manner, the coaxial cable assembly 40 of the present invention eliminates the need to remove the outer insulative jacket 44 and expose the ground wire braid 48 in the conventional manner and thereby eliminates any possibility of stray braid wires causing full or intermittent shorts. In the embodiment of FIGS. 1 and 2, a portion of the second length 32 of all six segments 26 makes contact with the ground wire braid 48 when the segments 26 are crimped to the end region 54 of coaxial cable 42 as described herein as each sharp edge 60 of each distal end 34 pierces the PVC jacket. As a practical matter, while the PVC jacket is easily pierced, the ground wire braid 48 is not and therefore a satisfactory engagement between each distal end 34 and the ground wire braid is effected.

Figure 3:
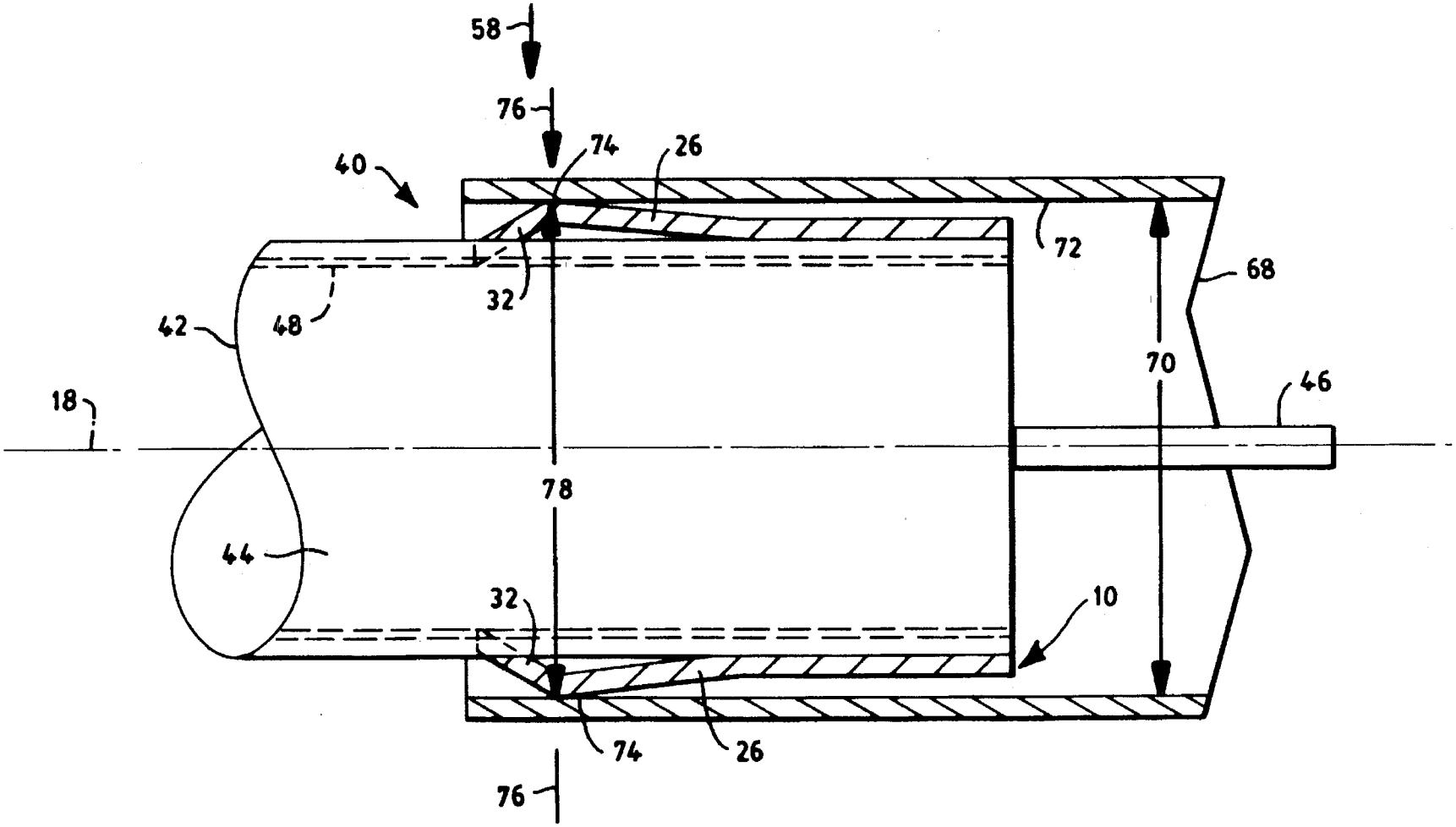
FIG. 3 is a partial view of the conductive cable clamp of FIG. 1 taken along the lines 2—2 depicting such conductive cable clamp in an operative mode in combination with a coaxial cable and including a conductor sleeve.

In the embodiment depicted in the drawings, the component 12 is generally cylindrical and includes a cylindrical inner surface 62 which lies in a first cylindrical plane having a diameter 64. Each distal end 34 lies in a second cylindrical plane which is concentric s with the first cylindrical plane and has a diameter which will vary relative to diameter 64 depending upon whether the cable clamp 10 is in an operative or inoperative mode. In particular, the diameter 64 of the first cylindrical plane will be (a) less than a diameter 66 of the second cylindrical plane when the cable clamp is in an inoperative mode as depicted in solid lines in FIG. 2, and (b) more than the diameter 66' of the second cylindrical plane when the cable clamp is in an operative mode as depicted in phantom lines in FIG. 2. The coaxial cable assembly 40 of FIG. 2 is depicted in FIG. 3 as being attached to a conventional cylindrical connector shell 68 of a conventional male or female connector such as the type used to provide a conventional antenna used in the automobile industry for radios. In such embodiment, the inner diameter 70 of the cylindrical connector shell 68 is dimensioned to cause the inner surface 72 of the connector shell 68 to exert a compressive force against the apex 74 of the segments 26. Such compressive force is in the direction 76 which is towards and substantially normal to longitudinal axis 18 of cable clamp 10 and facilitates maintaining each distal end 34 in electrical contact with the ground wire braid 48. In the embodiment of FIG. 3, this may be accomplished by providing a diameter 70 which is equal to or slightly less than the distance 78 between the apex 74 of opposing segments 26. In this manner, when the connector shell 68 is installed over the cable clamp 10 an interference fit causes a constant force to be applied against the ground wire braid 48 by the distal end 34 in the direction of arrow 76 resulting in a constant, consistent ground.

Figure 4:
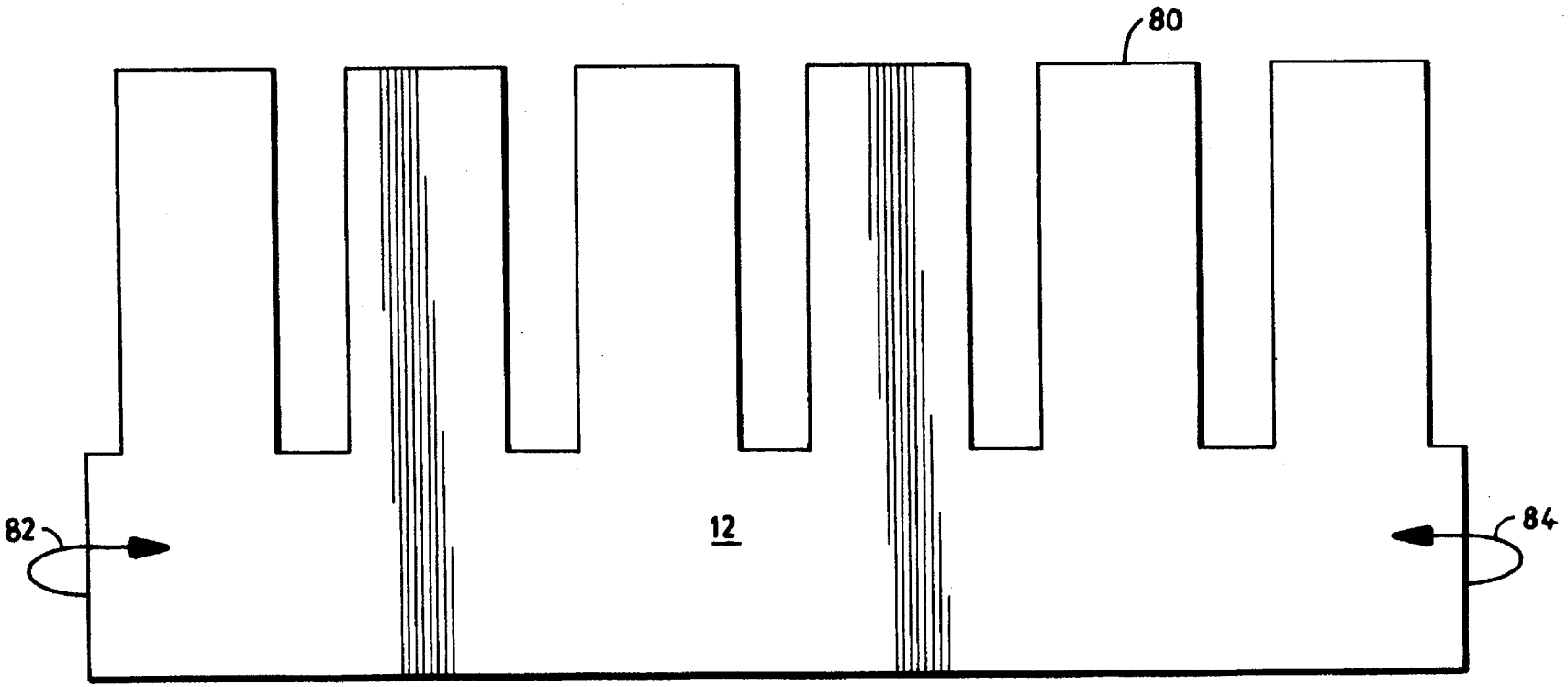
FIG. 4 is a plan view of a blank useful in fabricating the embodiment of FIG. 1.

The cable clamp 10 may be fabricated in a progressive die from a metal such as, for example, a soft brass or copper alloy. In such process, a blank 80 having a configuration as depicted in FIG. 4 may be cut from a reeled strip, formed into the configuration of FIG. 1 by bending the blank 80, and applying the cable clamp 10 so formed to the end of a coaxial cable 42 as described herein. In such process, the end of the coaxial cable may be inserted into the bore 56 of the cable clamp 10. Alternatively, the fabrication of the cable clamp 10 and its attachment to the coaxial cable 42 may be effected in a single process step by bending the cable clamp 10 in the direction designated by arrow 82 and/or arrow 84 directly upon the end region 54 of the coaxial cable.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A coaxial cable assembly, comprising:

a coaxial cable having an outer insulative jacket, a center conductor and a ground wire braid therebetween, said outer insulative jacket and said ground wire braid terminating at an end of said coaxial cable, and said center conductor including a length which extends beyond said end;

a conductive cable clamp having a bore extending therethrough, said coaxial cable having an end region which extends into said bore, said cable clamp comprising a first component which extends in a direction of a longitudinal axis of said cable clamp from a first end to an opposite second end, and a second component which extends from said first end in a direction of said longitudinal axis, said second component comprising a portion which penetrates said outer insulative jacket and engages said ground wire braid, and a connector shell attached to said end region, said connector shell being formed for longitudinally slidable, torque-free engagement with said penetrating portion, said penetrating portion being in contact with and sandwiched between said ground wire braid and said connector shell.

2. The conductive cable clamp of claim 1 wherein said second component comprises a segment comprising a first length extending away from said longitudinal axis to a juncture, and a second length extending towards said longitudinal axis from said juncture to a distal end.

3. The conductive cable clamp of claim 1 wherein said second component comprises a plurality of segments each of which comprises a first length extending away from said longitudinal axis to a juncture, and a second length extending towards said longitudinal axis from said juncture to a distal end.

4. The conductive cable clamp of claim 3 wherein each segment of said plurality of segments is spaced from an adjacent segment in a circumferential direction relative to said longitudinal axis.

5. The conductive cable clamp of claim 4 wherein said plurality of segments are equally spaced in said circumferential direction.

6. The conductive cable clamp of claim 3 wherein an inner surface of said first component lies in a first cylindrical plane and each distal end of said plurality of segments lies in a second cylindrical plane which is concentric with said first cylindrical plane, the diameter of said first cylindrical plane being (a) less than the diameter of said second cylindrical plane when said cable clamp is in an inoperative mode and (b) more than the diameter of said second cylindrical plane when said cable clamp is in an operative mode.

7. The conductive cable clamp of claim 1 wherein said first component is generally cylindrical.

8. The conductive cable clamp of claim 1 wherein said portion comprises a sharp edge.

9. The coaxial cable assembly of claim 1 wherein said second component comprises a segment comprising a first length extending away from said longitudinal axis to a juncture, and a second length extending towards said longitudinal axis from said juncture to a distal end.

10. The coaxial cable assembly of claim 1 wherein said second component comprises a plurality of segments each of which comprises a first length extending away from said longitudinal axis to a juncture, and a second length extending towards said longitudinal axis from said juncture to a distal end.

11. The coaxial cable assembly of claim 10 wherein each segment of said plurality of segments is spaced from an adjacent segment in a circumferential direction relative to said longitudinal axis.

12. The coaxial cable assembly of claim 11 wherein said plurality of segments are equally spaced in said circumferential direction.

13. The coaxial cable assembly of claim 12 wherein said first component is generally cylindrical.

14. The coaxial cable assembly of claim 1 wherein an inner surface of said first component lies in a first cylindrical plane and each distal end of said plurality of segments lies in a second cylindrical plane which is concentric with said first cylindrical plane, the diameter of said first cylindrical plane being (a) less than the diameter of said second cylindrical plane when said cable clamp is in an inoperative mode and (b) more than the diameter of said second cylindrical plane when said cable clamp is in an operative mode.

15. A coaxial cable assembly, comprising:

a conductive cable clamp having a bore extending therethrough formed to receive a coaxial cable, said cable clamp comprising a first component which extends in a direction of a longitudinal axis of said cable clamp from a first end to an opposite second end, and a second component which extends from said first end in a direction of said longitudinal axis, said second component comprising a portion which penetrates said outer insulative jacket and engages said ground wire braid, and a connector shell attached to said end region, said connector shell being formed for longitudinally slidable, torque-free engagement with said penetrating portion, said penetrating portion being in contact with and sandwiched between said connector shell and a ground wire braid when said coaxial cable assembly is installed on a coaxial cable.

* * * * *